US009065220B2

(12) United States Patent
Hsu

(10) Patent No.: US 9,065,220 B2
(45) Date of Patent: Jun. 23, 2015

(54) ELECTRICAL CONNECTOR

(71) Applicant: HON HAI PRECISION INDUSTRY CO., LTD., New Taipei (TW)

(72) Inventor: Shuo-Hsiu Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/156,488

(22) Filed: Jan. 16, 2014

(65) Prior Publication Data

US 2015/0017839 A1 Jan. 15, 2015

(30) Foreign Application Priority Data

Jul. 11, 2013 (TW) ..... 102213104 U

(51) Int. Cl.
*H01R 13/66* (2006.01)
*H01R 12/70* (2011.01)

(52) U.S. Cl.
CPC ..... *H01R 12/707* (2013.01)

(58) Field of Classification Search
USPC ..... 439/569, 570, 607.36
IPC ..... H01R 33/7628,23/02, 23/725, 23/7063, H01R 23/7042, 2103/00, 12/57; H04R 5/00; H05K 3/341
See application file for complete search history.

(56) References Cited

U.S. PATENT DOCUMENTS 6,379,186 B1 * 4/2002 Shi et al. ..... 439/607.36
6,755,671 B1 * 6/2004 Fan et al. ..... 439/108
7,074,085 B2 * 7/2006 Chen ..... 439/607.36

FOREIGN PATENT DOCUMENTS

TW M285832 1/2006

* cited by examiner

*Primary Examiner* — Hien Vu
(74) *Attorney, Agent, or Firm* — Wei Te Chung; Ming Chieh Chang

(57) ABSTRACT

An electrical connector (100) includes an insulative housing (1) with a plurality of contacts (11) received therein, a plurality of soldering members (12) connect the contacts (11) and protrude beyond the bottom of the insulative housing (1), and a position member (2) surrounds the insulative housing (1) and moves downwardly relative to the insulative housing (1), the insulative housing (1) includes an upper block (1010) and a lower block (1021) protruded outwardly, the position member (2) includes a body portion (20) and a soldering portion (21), the upper block (1010) locates under the body portion (20) and the lower block (1021) locates on the upper side of the body portion (20), when the soldering members (12) and the soldering portion (21) are put in a same plane, there is a space between the body portion (20) and the lower block (1021).

8 Claims, 5 Drawing Sheets

ELECTRICAL CONNECTOR

BACKGROUND OF THE INVENTION

1. Field of the invention

The present invention relates to an electrical connector, and more particularly to an electrical connector having an insulative housing moving downwardly when soldered to a substrate.

2. Description of related art

TW patent No. M285832 issued to Zhu on Jan. 11, 2006 discloses a conventional electrical connector for electrically connecting an IC package with a substrate. The electrical connector includes an insulative housing, a plurality of electrical contacts received in the insulative housing and a plurality of solder balls connected to the electrical contacts. The bottom of the insulative housing defines a post to position the insulative housing on the substrate and the solder balls connect with the substrate. When the electrical connector is assembled to the substrate, due to the insulative housing is positioned on the substrate by the post, it can not move downwardly when the solder balls are melted. Thus, some of the solder balls after melted may be disconnected with the substrate.

Hence, it is desirable to provide an improved electrical connector to overcome the aforementioned disadvantages.

SUMMARY OF THE INVENTION

Accordingly, an object of the present invention is to provide an electrical connector having an insulative housing moving downwardly when soldered to a substrate.

According to one aspect of the present invention, an electrical connector for soldering to a substrate comprises an insulative housing with a plurality of contacts received therein, a plurality of soldering members connected the contacts, respectively, a position member surrounds the insulative housing and moves downwardly relative to the insulative housing, the insulative housing includes an upper block and a lower block protruded outwardly, each of the soldering members protrude beyond the bottom of the insulative housing, the position member includes a body portion and a soldering portion extending from the body portion, the upper block of the insulative housing locates under the body portion of the position member and the lower block locates on the upper side of the body portion of the position member to prevent the position member distorting from the insulative housing, when the soldering members and the soldering portion are put in a same plane, there is a space between the body portion of the position member and the lower block of the insulative housing.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
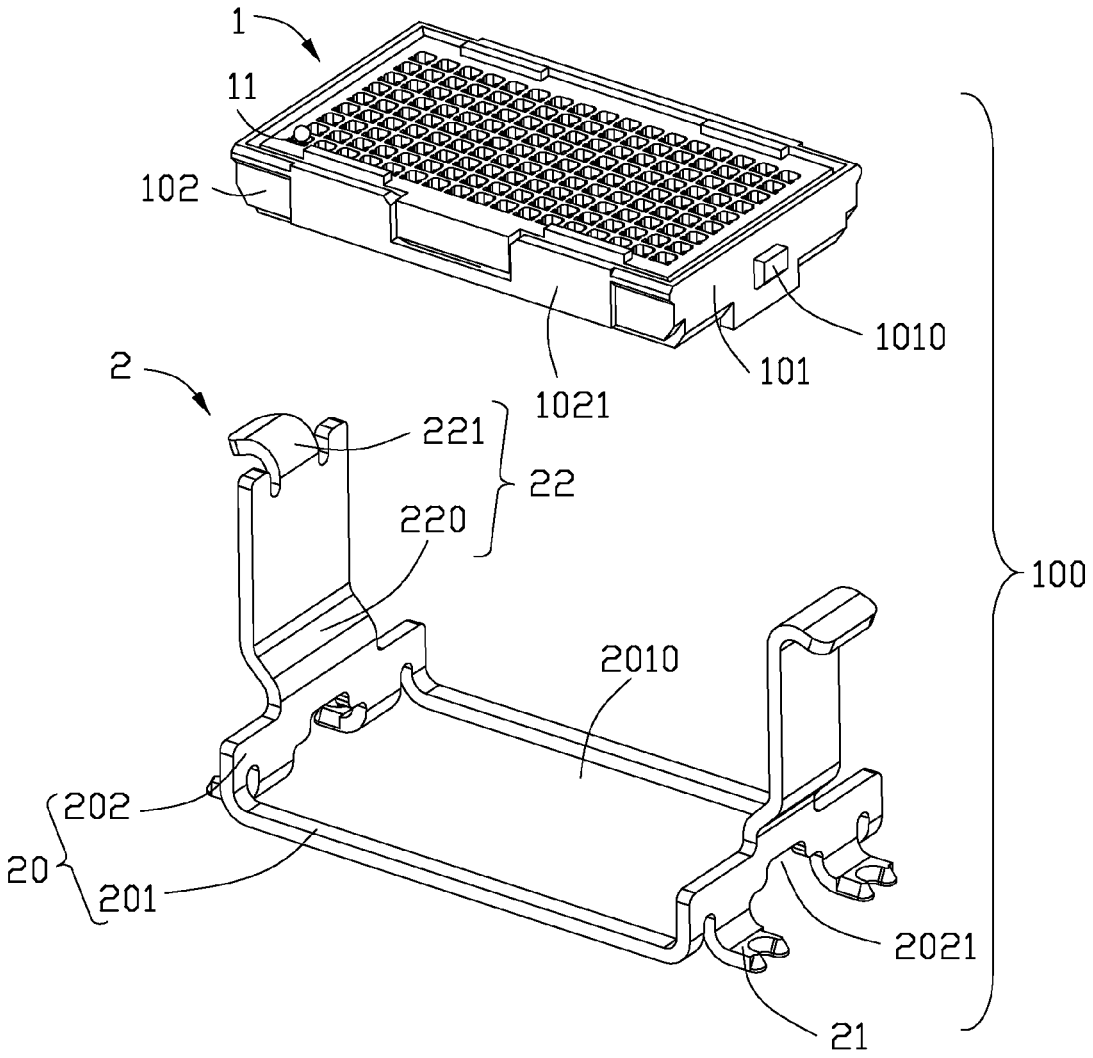
FIG. 1 is an exploded view of an electrical connector according to a preferred embodiment of the present invention.
Figure 2:
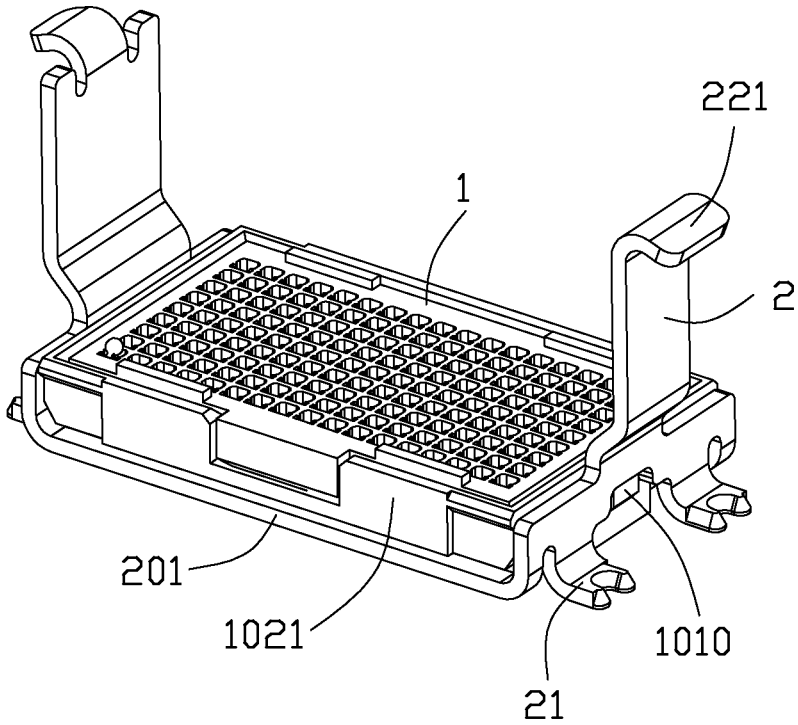
FIG. 2 is an assembled view of the electrical connector as shown in FIG. 1.
Figure 3:
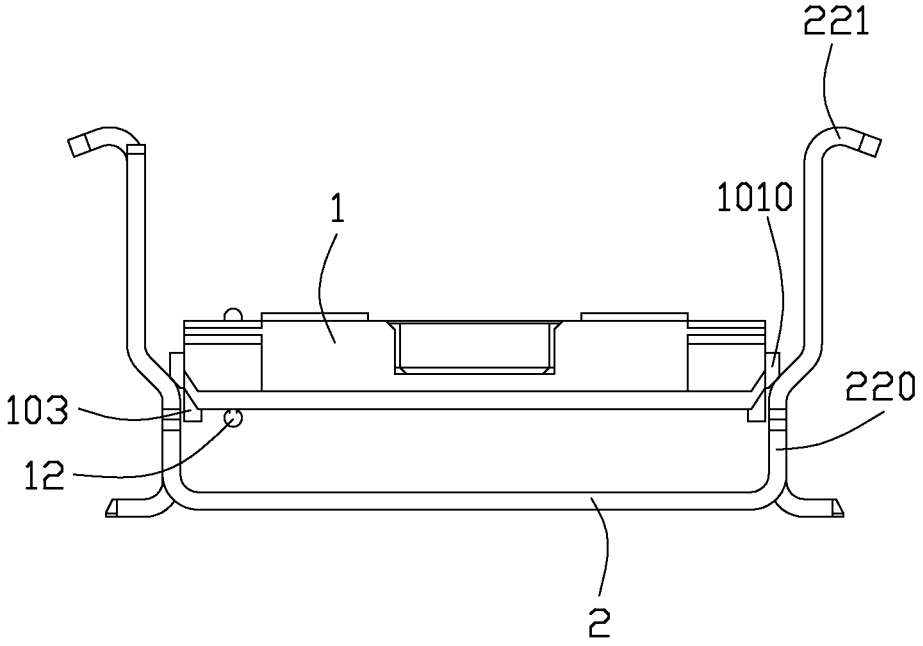
FIG. 3 is an isometric view showing the position member not assembled to the insulative housing.

FIGS. 1 and 3 illustrates an electrical connector 100 in accordance to a preferred embodiment of the present invention. The electrical connector 100 is soldered to a substrate 3 and comprises an insulative housing 1 with a plurality of electrical contacts 11 received therein, a plurality of soldering members 12 connected with the contacts 11 and a position member 2 surrounded the insulative housing 1 and moved upwardly and downwardly relative to the insulative housing 1. The soldering members 12 protrude beyond the bottom of the insulative housing 1.

The insulative housing 1 comprises a pair first ends 101 opposite to each other, a pair of second ends 102 connecting the pair of first ends 101, a pair of upper blocks 1010 set on the pair of first ends 101 and a pair of lower blocks 1021 set on the pair of second ends 102. The insulative housing 1 further includes a supporting member 103 extending downwardly. The soldering members 12 protrude beyond the bottom of the supporting member 103.

The position member 2 comprises a body portion 20, four soldering portions 21 extending downwardly from the body portion 20 and a pair of retention portions 22 extending upwardly from the body portion 20. The body portion 20 includes a pair of first sides 201 and a pair of second sides 202 extending upwardly from the pair of first sides 201. The pair of first sides 201 and the pair of second sides 202 form a window 2010 for receiving the insulative housing 1. The second side 202 includes a receiving portion 2021 for receiving the upper block 1010. The retention portion 22 includes a spring portion 220 extending upwardly from the body portion 20 and an interlock portion 221 extending upwardly from the spring portion 220.

Referring to FIG. 3, when assemble the electrical connector 100, the upper blocks 1010 of the insulative housing 1 push the spring portions 220 of the position member 2 to make the pair of spring portions 220 move away relative to each other, then the upper blocks 1010 of the insulative housing 1 slides to the receiving portions 2021 of the position member 2, thus the insulative housing 1 is assembled to the position member 2. Due to the body portion 20 of the position member 2 is limited by the upper blocks 1010 and the lower blocks 1021 of the insulative housing 1, the insulative housing 1 can not distort from the position member 2.

Figure 4:
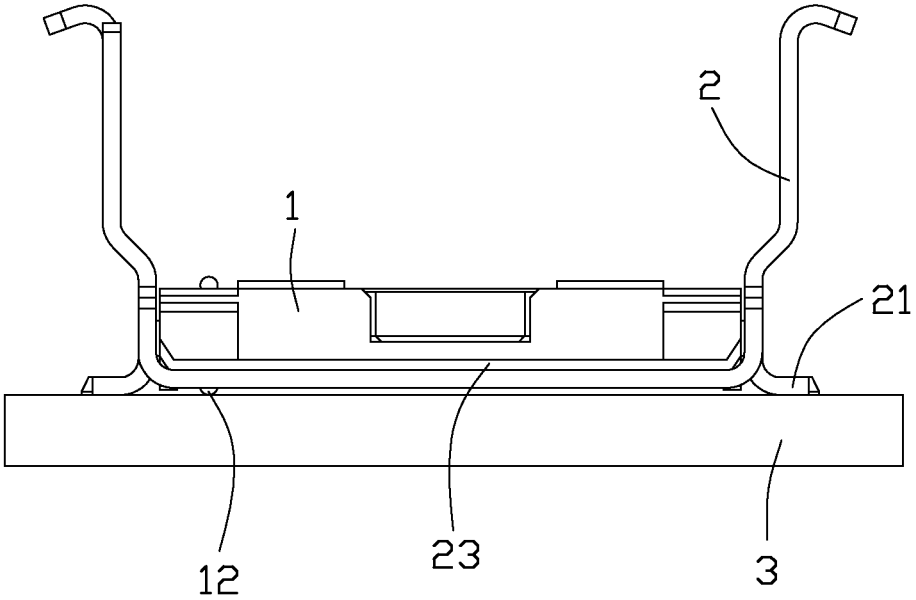
FIG. 4 is a side view of the electrical connector as shown in FIG. 2, showing the electrical connector not soldered to a substrate.

Referring to FIG. 4, when the electrical connector 100 is put on the substrate 3, the four soldering portions 21 of the position member 2 and the soldering members 12 of the electrical connector 100 are supported on the substrate 4, the body portion 20 of the position member 2 locates between the upper blocks 1010 and the lower blocks 1021, at the same time, there is a space between the first side 201 of body portion 20 and the lower block 1021 of the insulative housing 1. When the electrical connector 100 is soldered to the substrate 3, the four soldering members 21 of the position member 2 and the soldering members 12 of the electrical connector 100 are soldered to the substrate 3 during a same process.

Figure 5:
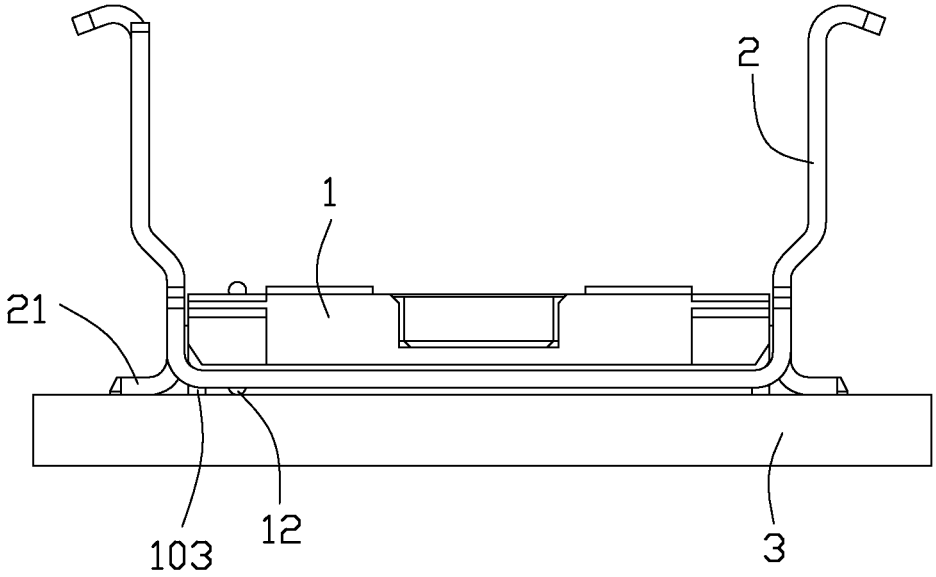
FIG. 5 is similar to FIG. 3, showing the electrical connector soldered to the substrate.

Referring to FIG. 5, during the process of soldering the electrical connector 100, the insulative housing 1 receives in the window 2010 of the position member 2 and moves downwardly when the soldering members 12 are melted, thus to ensure the connection between the soldering members 12 and the substrate 3. At the same time, after the insulative housing 1 moving downwardly, the supporting members 103 support on the substrate 3 to support the electrical connector 100.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector for soldering to a substrate, comprising:

an insulative housing comprising an upper block and a lower block protruded outwardly;

a plurality of contacts received in the insulative housing;

a plurality of soldering members connected the contacts, respectively, each of the soldering members protruded beyond a bottom of the insulative housing; and a position member surrounding the insulative housing and moved downwardly relative to the insulative housing, the position member including a body portion and a soldering portion extending from the body portion; wherein the upper block of the insulative housing is located under the body portion of the position member and the lower block is located on the upper side of the body portion of the position member to prevent the position member distorting from the insulative housing, when the soldering members and the soldering portion are put in a same plane, there is a space between the body portion of the position member and the lower block of the insulative housing;

wherein the insulative housing comprises a pair of first ends opposite to each other and a pair of second ends connecting the pair of first ends, the upper block is set on the first end, the lower block is set on the second end;

wherein the body portion includes a first side locates below the lower block and a second side extending upwardly from the first side, the second side locates on the upper side of the upper block, the space is formed between the first side of the body portion and the lower block of the insulative housing;

wherein the pair of first sides and the pair of second sides form a window for receiving the insulative housing, the second side includes a receiving portion for receiving the upper block; and wherein the position member further includes a retention portion extending upwardly from the body portion, the retention portion includes a spring portion extending upwardly from the body portion and an interlock portion extending upwardly from the spring portion, during the assembling process of the electrical connector, the upper block of the insulative housing push the spring portion to make it deformed.

2. The electrical connector as claimed in claim 1, wherein the insulative housing further includes a supporting member extending downwardly, the soldering members protrude beyond the bottom of the supporting member.

3. The electrical connector as claimed in claim 1, wherein when the electrical connector is soldered to the substrate, the soldering member of the position member and the soldering members of the electrical connector are soldered to the substrate during a same process.

4. An electrical connector for soldering to a substrate, comprising:

an insulative housing comprising a pair of opposite upper blocks and a pair of opposite lower blocks;

a plurality of contacts received in the insulative housing;

a plurality of soldering members connected the contacts, respectively, each of the soldering members protruded beyond the bottom of the insulative housing; and a position member surrounding the insulative housing and moveable downwardly relative to the insulative housing, the position member comprising a body portion including a pair of first sides and a pair of second sides having soldering portions, the pair of second sides connecting the pair of first sides;

wherein the distance between the pair of first sides is smaller than that of the pair of lower blocks, and the distance between the pair of second sides is smaller than that of the pair of upper blocks;

wherein the pair of upper blocks are located under the pair of second sides, respectively;

wherein the pair of first sides and the pair of second sides form a window for receiving the insulative housing, the second side includes a receiving portion for receiving the upper block; and wherein the position member further includes a retention portion extending upwardly from the second side, the retention portion includes a spring portion extending upwardly from the second side and an interlock portion extending upwardly from the spring portion, during the assembling process of the electrical connector, the upper block of the insulative housing push the spring portion to make it deformed.

5. An electrical connector for mounting to a printed circuit board, comprising:

an rectangular insulative housing including a pair of opposite long sides extending along a longitudinal direction, and a pair of opposite short sides extending along a transverse direction perpendicular to said transverse direction;

a pair of standoffs formed on an underside of the housing;

a pair of downwardly facing stopper surfaces and a pair of upwardly facing stopper surfaces formed on the housing;

a plurality of contacts disposed in the housing and upwardly exposed to an exterior; a plurality of solder balls attached to bottom ends of the corresponding contacts, respectively;

a metallic positioning member surrounding the housing and including a pair of soldering members around a bottom side thereof, and further including a pair of upwardly facing stopper faces in alignment/confrontation with the corresponding pair of downwardly facing stopper surfaces of the housing in a vertical direction perpendicular to both said longitudinal direction and said transverse direction, and a pair of downwardly facing stopper faces in alignment/confrontation with the corresponding pair of upwardly facing stopper surfaces of the housing in the vertical direction;

wherein before the connector is mounted to the printed circuit board, the housing is up and down floatable, in the vertical direction, relative to the shell within a range to have bottom surfaces of the standoffs capable of being flush with bottom surfaces of the soldering members to be commonly seated upon the printed circuit board, and said rang is defined by a lower limit by confrontation of said pair of upwardly facing stopper faces of the positioning member and said pair of downwardly facing stopper surfaces of the housing, and an upper limit by confrontation of said pair of downwardly facing stopper faces of the positioning member and said pair of upwardly facing stopper surfaces of the housing;

wherein the pair of upwardly facing stopping surfaces of the housing are formed on the corresponding short sides, respectively, while the downwardly facing stopper surface of the housing are formed on the corresponding long sides, respectively;

wherein said pair of soldering members are located beside the short sides; and wherein said positioning member includes a pair of upwardly extending spring arms beside the short sides to deflect the positioning member.

6. The electrical connector as claimed in claim 5, wherein the positioning member is configured with nothing above the upwardly facing stopper faces thereof in the vertical direction so as to allow the housing to be easily downwardly seated thereon without deflection of the positioning member.

7. The electrical connector as claimed in claim 6, wherein the positioning member is configured with nothing below the downwardly facing stopper faces thereof in the vertical direction while requiring deflection thereof to allow the upwardly facing stopper surfaces of the housing to downwardly pass by before the positioning member is resumed to an original position where the downwardly facing stopper faces downwardly confront the corresponding upwardly facing stopper surfaces of the housing in an assembled manner.

8. The electrical connector as claimed in claim 7, wherein said soldering member are located adjacent to the corresponding downwardly facing stopper faces, respectively, in the transverse direction.

* * * * *